United States Patent [19]

Kohlstette

[11] Patent Number: 4,479,788

[45] Date of Patent: Oct. 30, 1984

[54] CENTRIFUGE WITH A SELF-EMPTYING DRUM

[75] Inventor: Werner Kohlstette, Oelde, Fed. Rep. of Germany

[73] Assignee: Westfalia Separator AG, Oelde, Fed. Rep. of Germany

[21] Appl. No.: 544,750

[22] Filed: Oct. 24, 1983

[30] Foreign Application Priority Data

Nov. 6, 1982 [DE] Fed. Rep. of Germany ..... 3240998

[51] Int. Cl.[3] ..... B04B 11/02

[52] U.S. Cl. ..... 494/27; 494/40

[58] Field of Search ..... 494/27, 23, 29, 30, 494/56, 40, 38, 23

[56] References Cited

U.S. PATENT DOCUMENTS

| | | | |
|---|---|---|---|
| 3,189,267 | 6/1965 | Thylefors | 494/40 |
| 3,550,843 | 12/1970 | Hoffmann | 494/27 |
| 4,044,945 | 8/1977 | Kohlstette | 494/40 |
| 4,151,951 | 5/1979 | Kohlstette | 494/40 |
| 4,284,233 | 8/1981 | Kulker | 494/27 |

*Primary Examiner*—Robert W. Jenkins

*Attorney, Agent, or Firm*—Sprung Horn Kramer & Woods

[57] ABSTRACT

A centrifuge with a self-emptying drum has ejection openings in its jacket that lead out of a solids space and can be blocked off with a piston valve. It has a closure compartment that can be charged with closure fluid and is associated with the piston valve. Part of the closure compartment is divided into an upper and a lower division by a disk. Outflow channels lead out of the drum from the lower division of the closure compartment. The disk can be displaced axially. When it is in its lower position, it hermetically seals off the lower division of the closure compartment from the rest of the compartment. When it is in its upper position, into which it can be displaced hydraulically, the disk allows the lower division to communicate with the rest of the closure compartment so that closure fluid flows out of the compartment through its lower division and through outflow channels. Once a predetermined hydrostatic pressure has been attained in the lower division, the disk automatically returns to its lower position, terminating the outflow of closure fluid.

6 Claims, 1 Drawing Figure

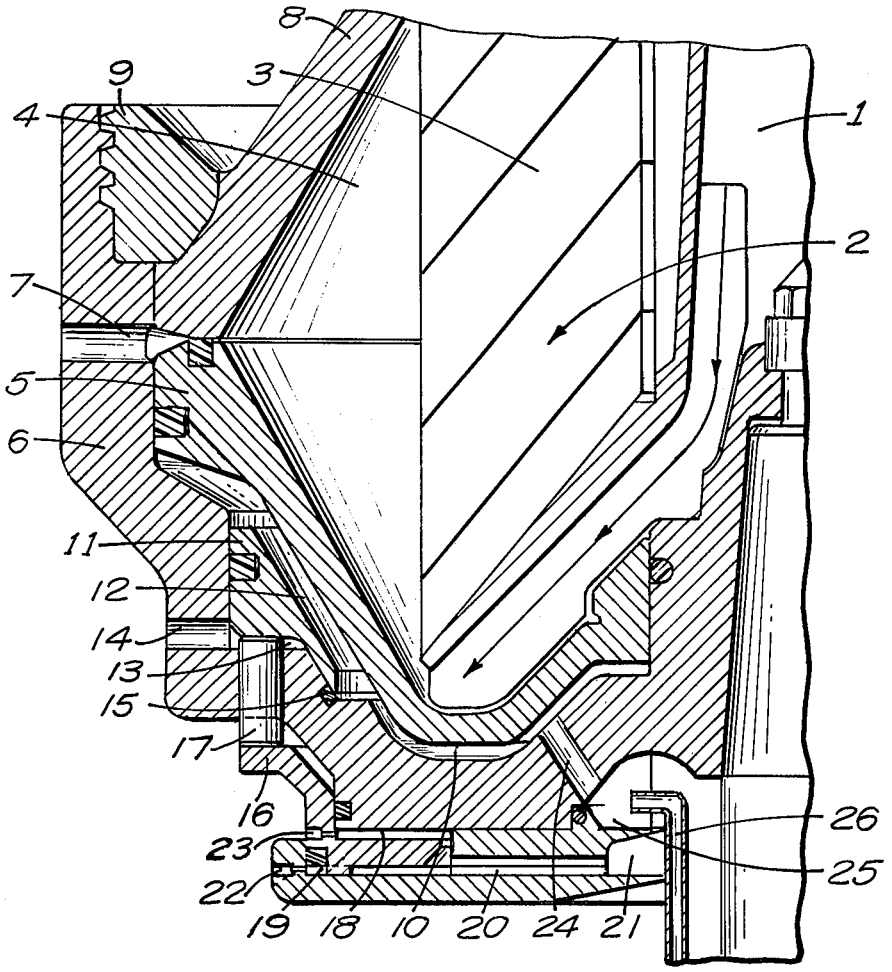
8
9
3
4
1
2
7
5
6
11
12
14
13
15
17
16
23
22
19
18
10
20
24
21
26
25

CENTRIFUGE WITH A SELF-EMPTYING DRUM

BACKGROUND OF THE INVENTION

The present invention relates to a centrifuge with a self-emptying drum with ejection openings in its jacket that lead out of a solids space and can be blocked off with a piston valve, with a closure compartment that can be charged with closure fluid and is associated with the piston valve, with part of the closure compartment being divided into an upper and a lower division, and with outflow channels leading out of the drum from the lower division of the closure compartment.

A centrifuge of this type is known from German Pat. No. 1 432 760. Its outflow channels leading out of the drum from the lower division of the closure compartment can be blocked off or uncovered with a hydraulic valve, the outflowing closure fluid automatically keeping the valve open. Thus, the valve cannot be closed until as much of the closure fluid as possible has flowed out. The closure compartment can therefore not be filled up again until the closure-fluid valve is closed again.

Self-emptying drums are preferably operated in such a way that only some of their contents are expelled when they are emptied without interrupting the supply of material to be centrifuged. To prevent the drum from opening automatically subsequent to emptying, the pressure below the piston valve must be restored more rapidly than that within the drum as it fills up. This is possible only if the closure compartment fills up again rapidly subsequent to emptying. With known drums, however, there is a delay until the lower division of the closure compartment has emptied. This type of drum can accordingly be emptied only when the material-supply inlet is closed.

Filling at least the upper division of the closure compartment before the closure-fluid valve closes through a special device that conveys the closure fluid into that division first has been proposed. In this case as well, however, the total closure compartment cannot be filled until the closure-fluid valve is closed. This also entails the risk that the pressure inside the drum will be restored more rapidly than that in the closure compartment. Decelerating the pressure buildup in the closure compartment also means the same thing as slow closure. This makes it impossible to obtain a piston-valve stroke that is as high as possible when the drum is emptied partially. When the piston valve goes through a partial-opening motion, however, optimum solids extraction is impossible because the small total ejection-opening cross-section freed by the piston valve does not allow the rings of solids to break up.

SUMMARY OF THE INVENTION

The object of the present invention is to provide a centrifuge of the aforesaid type in which pressure build-up in the closure compartment, and hence the closure process, is accelerated.

This object is attained in accordance with the invention in a centrifuge in which a disk can be displaced axially, in which the disk, when it is in its lower position, hermetically seals off a lower division of the closure compartment from the rest of the compartment and, when it is in its upper position, into which it can be displaced hydraulically, allows the lower division to communicate with the rest of the closure compartment so that closure fluid flows out of the compartment through its lower division and through outflow channels, and in which, once a predetermined hydrostatic pressure has been attained in the lower division, the disk automatically returns to its lower position, terminating the outflow of closure fluid.

A preferred embodiment of the invention will now be described with reference to the attached drawing.

BRIEF DESCRIPTION OF THE DRAWING

The Figure is a vertical section through part of the centrifuge according to the invention.

DETAILED DESCRIPTION OF THE INVENTION

The material to be centrifuged is supplied to a centrifuging space 2 consisting of a separation space 3 and a solids space 4 through a centrally located inlet 1. Solids space 4 is bounded on one side by a piston valve 5 that moves axially to block off or uncover solids-ejection openings 7 in the bottom 6 of the drum.

The drum also has a cover 8 that is tightly fastened to bottom 6 with a locking ring 9.

Between piston valve 5 and the bottom 6 of the drum is a closure compartment 10 that can be charged with closure fluid. The radially outer area of closure compartment 10 is divided by a disk 11 into an the upper division 12 and a lower division 13. Outflow channels 14 lead out of the bottom 6 of the drum from the lower division 13 of closure compartment 10. Disk 11 can be displaced axially. When it is in its lower position, disk 11 hermetically seals off the lower division 13 of the closure compartment from the rest of the compartment with a gasket 15. Below the bottom 6 of the drum is a hydraulic piston 16 that can force disk 11 into its upper position by means of bolts 17. Compartments 18 and 19 are associated with piston 16 and communicated through certain channels 20 with another compartment 21. Compartments 18 and 19 are provided with emptying channels 22 and 23. Closure compartment 10 communicates through channels 24 with still another compartment 25 that can be charged with fluid from control-water supply 26.

Before the inlet 1 for the material to be centrifuged is opened, closure compartment 10 is charged with closure fluid from control-water supply 26 through channels 24 and compartment 25 until the level of fluid in the compartment 25 generates a pressure in control-water supply 26, which is shaped like a paring disk, that equals the pressure of control water being supplied. This fluid level is maintained automatically from control-water supply 26. Disk 11 is displaced by the closure-fluid pressure building up above it into its lower position, sealing off the lower division 13 of the closure compartment from the rest of the compartment with gasket 15 so that no more closure fluid can flow out of channels 14.

Partial emptying occurs once a specific amount of solids has collected in solids space 4. This process is initiated by briefly raising the control-water pressure in control-water supply 26, causing compartment 25 to overflow. The overflowing control water flows into a gutter 21 and then through channels 20 first into compartment 19 and then into compartment 18, so that piston 16 is powerfully lifted by the fluid pressure building up in compartment 19 and, once compartment 18 is full, only a relatively weak residual force will remain. The force on piston 16 is powerful enough even though it is only brief to lift disk 11 from gasket 15 with bolts 17.

The closure fluid now flows out of closure compartment 10 into the lower division 13 of closure compartment 10 and is then let out through outflow channels 14. Equal fluid pressure above and below disk 11 and on similarly loaded areas now stabilizes disk 11, which maintains its upper position until the level of liquid in closure compartment 10 drops low enough to reach the inner limit of disk 11. Further lowering of the fluid level to the vicinity of the lower division 13 of closure compartment 10 produces a differential force on the upper division 12 of the closure compartment, which cannot empty, so that disk 11 is again forced against gasket 15, terminating the outflow of closure fluid. Closure compartment 10 is immediately refilled by the control water that continues to flow into compartment 25 throughout the emptying process.

As the fluid level in closure compartment 10 drops and the closure force affecting piston valve 5 accordingly decreases, the valve begins to open and does not stop until disk 11 again closes off the lower division 13 of closure compartment 10. As the material to be centrifuged continues to flow in, closure can be carried out rapidly when the closure compartment 10 fills up essentially more rapidly than centrifuging space 2. Since disk 11 automatically interrupts the outflow of closure fluid when a predetermined level has been attained, not only can uniform volumes of solids be reproducibly extracted satisfactorily but closure can be immediately initiated reliably once piston valve 5 has opened as far as it can.

It will be appreciated that the instant specification and claims are set forth by way of illustration and not limitation, and that various modifications and changes may be made without departing from the spirit and scope of the present invention.

What is claimed is:

1. In a centrifuge with a self-emptying drum with ejection openings in its jacket that lead out of a solids space and which can be blocked off with a piston valve having an associated closure compartment chargable with closure fluid, means dividing the closure compartment into an upper and a lower division, and outflow channels leading out of the drum from the lower division of the closure compartment, the improvement wherein the dividing means comprises a disk mounted for axial displacement in the closure compartment between a lower position wherein it hermetically seals off the lower division of the closure compartment from the rest of the compartment and an upper position wherein it permits communication between the lower division and the rest of the closure compartment whereby closure fluid flows out of the closure compartment through its lower division and through the outflow channels, means for hydraulically displacing the disk from the lower to the upper position thereof and wherein the disk is automatically returnable to its lower position to terminate the outflow of closure fluid upon the attainment of a predetermined hydrostatic pressure in the lower division.

2. The centrifuge as in claim 1, wherein means for hydraulically displacing the disk comprises bolts bearing on the disk and actuated by a hydraulic piston below the piston valve.

3. The centrifuge as in claim 2, wherein the means for hydraulically displacing the disk further comprises two compartments associated with the hydraulic piston and which communicate through a constricted passage and operate in opposition to each other on the hydraulic piston.

4. The centrifuge as in claim 3, wherein the means for hydraulically displacing the disk further comprises channels positioned to fill up the two compartments such that first one compartment fills up urging the disk into its upper position and then the other compartment.

5. The centrifuge as in claim 4, further comprising a compartment in communication with the closure compartment through channels and means for keeping the control compartment filled to a predetermined level comprising a paring disk control-water supply.

6. The centrifuge as in claim 5, further comprising a gutter positioned below the control compartment and communication with the hydraulic piston compartments through channels.

* * * * *